US005525100A

United States Patent [19]

Kelly et al.

[11] Patent Number: 5,525,100

[45] Date of Patent: Jun. 11, 1996

[54] ABRASIVE PRODUCTS

[75] Inventors: Robert G. Kelly, Latham; Gary J. Kardys, Wynantskill, both of N.Y.

[73] Assignee: Norton Company, Worcester, Mass.

[21] Appl. No.: 336,729

[22] Filed: Nov. 9, 1994

[51] Int. Cl.[6] ..... B24D 11/00

[52] U.S. Cl. ..... 451/527; 451/533; 451/534; 451/539

[58] Field of Search ..... 451/526, 527, 451/528, 529, 530, 533, 534, 539

[56] References Cited

U.S. PATENT DOCUMENTS

| | | | |
|---|---|---|---|
| 2,001,911 | 5/1935 | Wooddell et al. | 451/529 |
| 2,665,528 | 1/1954 | Sternfield et al. | 451/534 |
| 2,907,146 | 10/1959 | Dyar | 451/529 |
| 3,991,527 | 11/1976 | Maran | 451/529 |
| 4,788,718 | 12/1988 | Defranco et al. | 451/527 |
| 5,092,910 | 3/1992 | deKok et al. | 51/294 |
| 5,103,598 | 4/1992 | Kelly | 51/295 |
| 5,199,227 | 4/1993 | Ohishi | 451/527 |
| 5,226,929 | 7/1993 | Morii et al. | 51/298 |
| 5,327,688 | 7/1994 | Norkus | 451/539 |
| 5,372,620 | 12/1994 | Rowse et al. | 51/309 |

*Primary Examiner* Maurina T. Rachuba
*Attorney, Agent, or Firm* David Bennett

[57] ABSTRACT

Coated abrasive materials can be made from a backing material and abrasive elements which comprise abrasive particles adhered to a rigid base material, said elements being rigidly adhered to the backing material in a predetermined pattern.

7 Claims, 1 Drawing Sheet

ABRASIVE PRODUCTS

BACKGROUND OF THE INVENTION

This invention relates to coated abrasive products that can be made very simply and reproducibly by an easily automated production process.

In a conventional process for the manufacture of coated abrasives, a backing is prepared and then treated with a coat of a maker resin which is then partially cured before a layer of abrasive particles is deposited thereon. The maker coat is then cured and a further binder coat, referred to as a size coat, is applied over the abrasive grains.

The abrasive grain is applied either by gravity coating or by an electrostatic process in which the grains are impelled towards the surface to be coated by electrostatic forces. This is referred to as the UP coating technique.

In such processes the product is conventionally obtained in the form of a roll which is then cut to form discs or strips some of which may be formed into belts. Clearly such a process implies the parallel formation of a significant amount of waste material. Particularly when the grain cost is a significant element in the overall cost of the product, this is a waste that it is desirable to avoid.

In recent years a new form of grain has been developed. This grain has a filamentary particle form with a substantially uniform cross-sectional shape and a length dimension perpendicular to that cross-section that is at least as long as the greatest dimension of the cross-section. One form of such grains is made from a sol-gel alumina that has been shaped into the filamentary particle shape before it is dried and fired to produce a remarkably effective abrasive grain. Such grains are described in U.S. Pat. No. 5,009,676 and coated abrasives made using such particles are described in U.S. Pat. No. 5,103,598.

It has now been found that coated abrasives comprising abrasive particles and particularly filamentary abrasive particles, can be obtained in a highly flexible and efficient way that permits the "customizing" of a coated abrasive to a specific application. Use of the technique will result in minimum wastage of grain and maximum targeted effectiveness of the grain that is used.

Use of the present invention will also avoid the danger that filamentary particles deposited on a substrate may be constrained to adopt a position that departs from the desired orientation before the binder has hardened to the extent that the orientation is fixed.

GENERAL DESCRIPTION OF THE INVENTION

The present invention provides a coated abrasive having a plurality of abrasive elements each comprising a base pad and a plurality of abrasive particles each adhered by an extremity thereof to one surface of the pad, said elements being adhered to a backing material in a predetermined configuration.

SPECIFIC DESCRIPTION OF THE INVENTION

The base pad may have any suitable shape but in general a circular disc is most satisfactory. However square, diamond, oval or even irregular discs can be conceived as embodiments of this part of the element.

The abrasive particles can be of any type including fused and sol-gel aluminas, alumina-zirconia, silicon carbide, garnet and the like. The particles can have any desired shape such as predetermined similar shapes, or random shapes.

They are however often similar in size so as to fit into the same grit classification. Because of the manner in which they are used it is often preferred that the particles have one dimension significantly longer than the others. Such particles are said to have a "weak shape". Weak shapes are produced either by the formation process or by the manner of crushing larger masses of the abrasive. One particularly advantageous form of abrasive particle for the practice of this invention-is the filamentary abrasive particle. Such particles, when used in the present invention, are preferably of substantially the same length so that the ends remote from the surface of the base pad are at the same distance from the surface. However is some circumstances differential lengths could have some advantages.

The preferred material from which the abrasive particles may be made is a sol-gel alumina. Methods of making such sol-gel aluminas are described in U.S. Pat. Nos. 4,314,827; 4,623,364; 4,770,671; 4,788,167; 4,848,041; 4,881,951; 5,076,815; 5,139,978; 5,185,299; 5,203,884; 5,204,300; 5,219,806; 5,236,471; and others.

The material from which the base pad is made may be the same as that from which the abrasive particles are formed. Thus in the case of products having sol-gel alumina filamentary abrasive particles, the base pad and the filaments could be formed simultaneously in a single operation which could be for example a molding or casting operation. Alternatively the filaments could be placed with one end of each located in an unsolidified sol-gel alumina disc that could then be dried and fired with the particles in place to form an alumina base pad with which the filamentary abrasive particles are chemically identical and in which the particles are rooted.

Alternatively the pad can be made from a material that is more conventionally used as a binder in the construction of coated abrasives. This might therefore be a phenolic resin, an epoxy resin, a radiation curable polyurethane (including modified polyurethanes), melamine formaldehyde resins, urea formaldehyde resins and the like. Such a pad may conveniently be chosen to be compatible with the binder to which it is to be applied in the production of a coated abrasive employing the elements of the invention.

Yet another alternative is to make the base pad out of a fibrous material that is then impregnated with a curable resin formulation. The fibers then help retain the upright orientation of the filamentary particles while the resin cures.

In addition to the alternatives discussed above the base pad may be made from a vitreous material or a metal provided the base can be formed at a temperature below that at which the performance of the abrasive particles is significantly affected.

The abrasive elements according to the invention may be applied to any suitable form of coated abrasive. Generally however the greatest advantage is to be found when the elements are used to form an abrasive disc. In such a case it is preferred to form the elements with the base pad in the form of a circular disc with a diameter that is less than about 40% and preferably less than about 25% of the diameter of the disc. The elements are disposed around the disc in such a fashion as to provide the maximum usable abrading surface. This might be in the form of two or more rings of elements around the disc, with one ring inside the other, optionally with the elements radially off-set with respect to the elements in the adjacent ring(s).

DESCRIPTION OF PREFERRED EMBODIMENT OF THE INVENTION

The invention is now described with reference to the attached drawings which are solely for the purpose of illustration and are intended to imply no necessary limitation on the scope of the invention.

Figure 1:
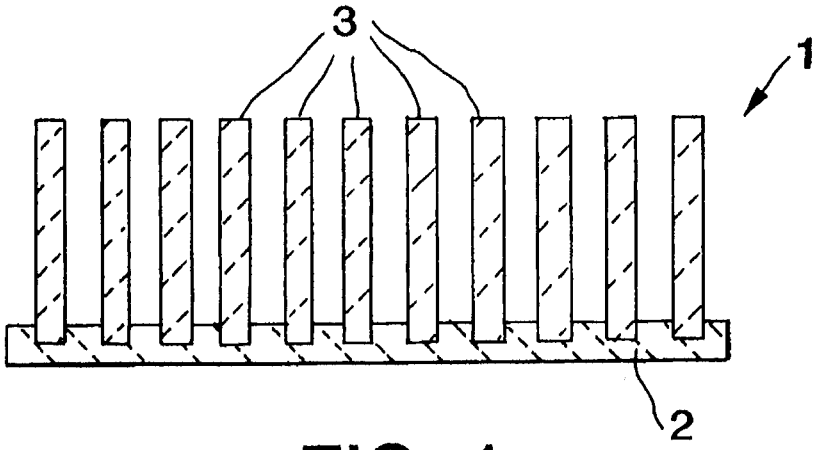
FIG. 1 is a cross-sectional view of an abrasive element according to the invention.
Figure 2:
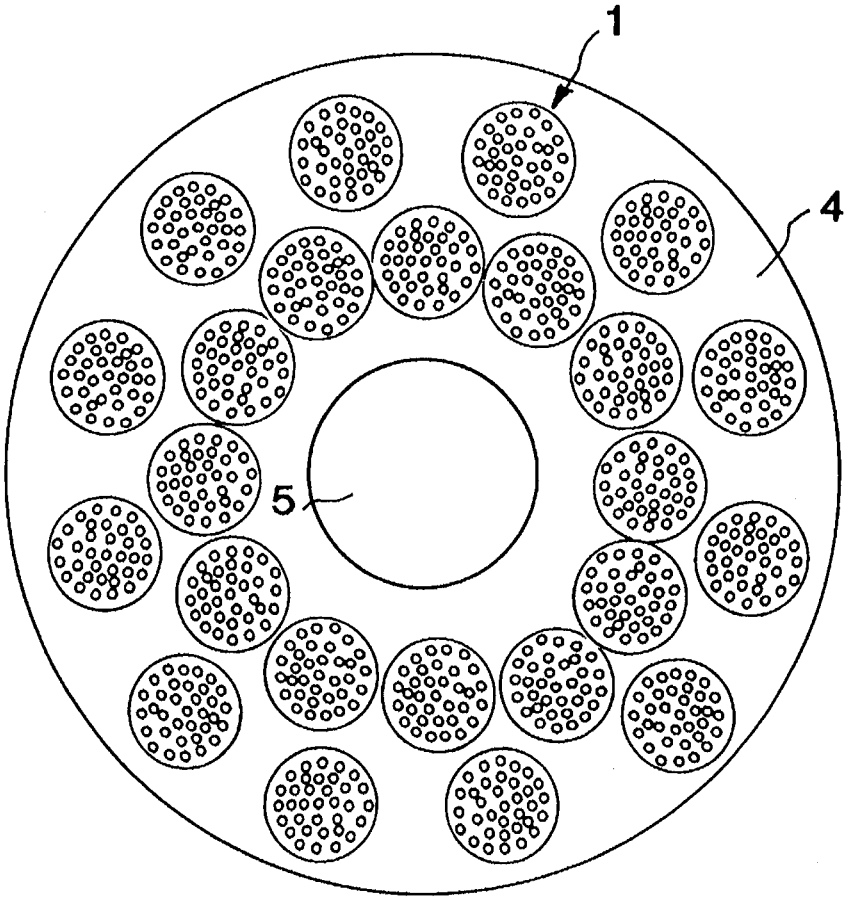
FIG. 2 is a plan view of an abrasive disc comprising abrasive elements according to the invention.

Referring to the Drawings, an abrasive element 1 comprises a base pad 2 and a plurality of filamentary particles 3 having one end of each particle rooted in the base. In FIG. 2 the elements illustrated in FIG. 1 are shown disposed in two concentric rings upon the surface of a disc 5 having a central attachment location 5.

In a particular embodiment of the invention as portrayed in the Drawings, a pool of a phenolic resin is prepared in a round mold and filamentary abrasive particles formed of a seeded sol-gel alumina by a process as described in U.S. Pat. No. 5,090,968 having a length of 4 mm and a diameter of 0.5 mm were UP coated onto the surface of the resin which is then cured until dimensionally stable thus forming an abrasive element suitable for use in the invention.

Several such elements are then placed on a filled woven fabric backing material coated with a maker coat of the same phenolic resin from which the base pad of the elements is formed. The elements are arranged in concentric circles around the circumference of the disc as shown in FIG. 2. The maker resin is then cured and a size coat is applied over the top of the abrasive elements and cured.

The abrasive disc thus formed is an effective tool for a wide range of abrading applications.

What is claimed is:

1. A coated abrasive having a plurality of abrasive elements each comprising a base pad and a plurality of filamentary abrasive particles each adhered by one extremity to one surface of the pad, said elements being adhered to a backing material in a predetermined configuration.

2. A coated abrasive according to claim 1 in which the abrasive elements have base pads in the form of a circular disc.

3. An coated abrasive according to claim 1 in which the base pad is made from the same material as the abrasive particles.

4. A coated abrasive according to claim 1 in the form of a disc in which the abrasive elements are arranged in one or more concentric circles around the periphery of the disc.

5. A coated abrasive according to claim 1 in which the abrasive particles are formed from a sol-gel alumina.

6. A coated abrasive according to claim 5 in which the sol-gel alumina is a seeded sol-gel alumina.

7. A coated abrasive in the form of a disc comprising a backing material and a plurality of abrasive elements each element comprising a base pad and a plurality of seeded sol-gel alumina filamentary abrasive particles each adhered by one extremity to one surface of the pad, said elements being adhered to the backing material in a plurality of concentric circles.

* * * * *